US006746214B2

(12) United States Patent
Okada et al.

(10) Patent No.: US 6,746,214 B2
(45) Date of Patent: Jun. 8, 2004

(54) CONTROL VALVE FOR COMPRESSORS AND MANUFACTURING METHOD THEREOF

(75) Inventors: Satoru Okada, Ogaki (JP); Takayuki Sakai, Ogaki (JP); Takaaki Ichikawa, Ogaki (JP)

(73) Assignee: Pacific Industrial Co., Ltd., Gifu-ken (JP)

( * ) Notice: Subject to any disclaimer, the term of this patent is extended or adjusted under 35 U.S.C. 154(b) by 0 days.

(21) Appl. No.: 10/084,610

(22) Filed: Feb. 27, 2002

(65) Prior Publication Data

US 2002/0141881 A1 Oct. 3, 2002

(30) Foreign Application Priority Data

Mar. 1, 2001 (JP) ..... 2001-056093

(51) Int. Cl.[7] ..... F04B 1/26
(52) U.S. Cl. ..... 417/222.2; 417/53
(58) Field of Search ..... 417/222.2, 269, 417/270, 53; 251/129.05, 129.15; 62/228.2, 228.3, 228.5; 137/487.5, 565.16

(56) References Cited

U.S. PATENT DOCUMENTS 5,145,326 A * 9/1992 Kimura et al. ..... 417/222.2
5,762,476 A * 6/1998 Ota et al. ..... 417/222.2
6,164,925 A * 12/2000 Yokomachi et al. ..... 417/222.2
6,192,699 B1 * 2/2001 Kato et al. ..... 62/228.3
6,213,727 B1 * 4/2001 Kawaguchi ..... 417/222.2
6,302,656 B1 * 10/2001 Hirota ..... 417/222.2
6,334,759 B1 * 1/2002 Kaneko et al. ..... 417/222.2

FOREIGN PATENT DOCUMENTS

JP 06-173852 * 6/1994
JP 9-268973 10/1997
JP 2000-249051 * 9/2000

* cited by examiner

*Primary Examiner*—Justine R. Yu
*Assistant Examiner*—Han L Liu
(74) *Attorney, Agent, or Firm*—Patterson, Thuente, Skaar & Christensen, P.A.

(57) ABSTRACT

A highly accurate and relatively inexpensive control valve for a compressor. The control valve includes a pressure sensitive portion that has a metal diaphragm, which is machined with a relatively low cost. The diaphragm is held between flanges. The pressure sensitive portion is attached to a control valve portion after being subjected to a pressure leak test. The control valve portion has an engaging piece and a positioning surface. The flange contacts the positioning surface and is fixed by the engaging piece. The positioning surface is formed such that the interval between the diaphragm and the top of the valve chamber becomes a predetermined value.

17 Claims, 8 Drawing Sheets

CONTROL VALVE FOR COMPRESSORS AND MANUFACTURING METHOD THEREOF

BACKGROUND OF THE INVENTION

The present invention relates to control valves for controlling displacement of variable displacement compressors used in, for example, automobile air conditioners, and, more particularly, to improvement of pressure sensitive portions that detect suction pressure of compressors.

Japanese Laid-Open Patent Publication No. 9-268973 discloses a conventional control valve 1 for a variable displacement compressor. The control valve 1 is located in a refrigerant gas passage that connects a discharge pressure zone to a crank chamber of the compressor. The control valve 1 adjusts the pressure in the crank chamber to vary the displacement of the compressor. With reference to FIG. 8, the control valve 1 includes a body 21, which accommodates a valve body 23, and a pressure sensitive portion 10, which is connected to the body 21. The pressure sensitive portion 10 includes a case 13 and a pressure sensitive member, or a metal bellows 11, which is accommodated in the case 13. The bellows 11 is soldered to an upper dolly block 15*a* and a lower dolly block 15*b*, which oppose each other. A pressure sensitive chamber is formed in the bellows 11. The bellows 11 moves in accordance with suction pressure Ps of the compressor and senses the suction pressure Ps. The lower dolly block 15*b* is joined with a transmitting rod 22. The lower dolly block 15*b* and the transmitting rod 22 transmit the movement of the bellows 11 to the valve body 23.

An adjuster 18 is fitted to an upper opening of the case 13. The adjuster 18 adjusts the urging force of the bellows 11. More specifically, the interval between the upper dolly block 15*a* and the lower dolly block 15*b*, or the longitudinal dimension of the bellows 11, is changed depending on the position of the adjuster 18. The change in the longitudinal dimension, or spring load, of the bellows 11 affects the characteristics (the valve opening pressure) of the control valve 1. The conventional control valve 1 regulates the characteristics of the control valve 1 by adjusting the position of the adjuster 18.

Since the machining cost of the bellows 11 is relatively high, the bellows 11 makes it difficult to lower the manufacturing cost of the control valve 1.

To enable the control valve 1 to operate stably, it is preferred that the pressure sensitive chamber be maintained substantially as vacuum. However, since the bellows 11 is soldered to the upper dolly block 15*a* and the lower dolly block 15*b*, a volatile substance generated by the soldering, such as flux, may enter the pressure sensitive chamber. This decreases the vacuum level of the pressure sensitive chamber. Further, air bubbles or cavities formed in the solder may cause a slow leak, thus changing the vacuum level of the pressure sensitive chamber. If the pressure in the pressure sensitive chamber is changed, the accuracy of the control valve 1 is lowered. Instead of the soldering, the bellows 11 may be connected to the upper dolly block 15*a* and the lower dolly block 15*b* using lazar. However, since the cost for lazar welding equipment is relatively high, the manufacturing cost of the control valve 1 is increased, which is problematic.

SUMMARY OF THE INVENTION

It is an objective of the present invention to provide a highly accurate and relatively inexpensive control valve.

To achieve the above objective, an embodiment of the present invention provides a control valve of a variable displacement compressor, which includes a suction passage in which refrigerant gas at a relatively low pressure flows, a discharge pressure zone in which the refrigerant gas compressed at a relatively high pressure flows, a crank chamber that accommodates a cam, and a supply passage that connects the discharge pressure zone to the crank chamber. The control valve includes a body, which accommodates a valve body that opens or closes a valve hole connected to the supply passage, and a pressure sensitive portion, which is fixed to the body for detecting the pressure in the suction passage. The pressure sensitive portion includes a diaphragm, which is moved in relation to the pressure in the suction passage, a first case, which has a first flange and cooperates with the diaphragm to define a pressure sensitive chamber, and a second case, which has a second flange that cooperates with the first flange to hold the diaphragm.

Another embodiment provides a control valve of a variable displacement compressor, which includes a suction passage in which refrigerant gas at a relatively low pressure flows, a discharge pressure zone in which the refrigerant gas compressed at a relatively high pressure flows, a crank chamber that accommodates a cam, and a supply passage that connects the discharge pressure zone to the crank chamber. The control valve includes a pressure sensitive portion, which detects the pressure in the suction passage. The pressure sensitive portion includes a diaphragm, which is moved in relation to the pressure in the suction passage, a first case, which has a first flange and cooperates with the diaphragm to define a pressure sensitive chamber, and a second case, which has a second flange that cooperates with the first flange to hold the diaphragm. The control valve further includes a body, which accommodates a valve body for opening or closing a valve hole connected to the supply passage, and a positioning surface, which is formed in the body for positioning the diaphragm by contacting the second case.

Another embodiment of the present invention provides a method for manufacturing a control valve of a variable displacement compressor. The control valve includes a body, which accommodates a valve body that changes the opening size of a valve hole, and a pressure sensitive portion, which is attached to the body for detecting the pressure in the compressor. The method includes the steps of forming a positioning surface in the body at a position corresponding to a predetermined interval from the valve hole, accommodating a pressure sensitive spring and a pair of dolly blocks, which holds opposite ends of the pressure sensitive spring, in a first case that has a first flange, accommodating a connecting member in a second case that has a second flange, fixing the first case and the second case by clamping a diaphragm between the first flange and the second flange, setting the pressure in a pressure sensitive chamber, which is defined by the diaphragm and the first case, to a predetermined value, and attaching the pressure sensitive portion to the body by enabling the second case to contact the positioning surface of the body.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objectives and advantages thereof, may best be understood by reference to the following description of the presently preferred embodiments together with the accompanying drawings in which.

DETAILED DESCRIPTION OF THE PREFERRED EMBODIMENTS

A control valve 1*a* according to a first embodiment of the present invention will now be described with reference to the drawings.

Figure 7:
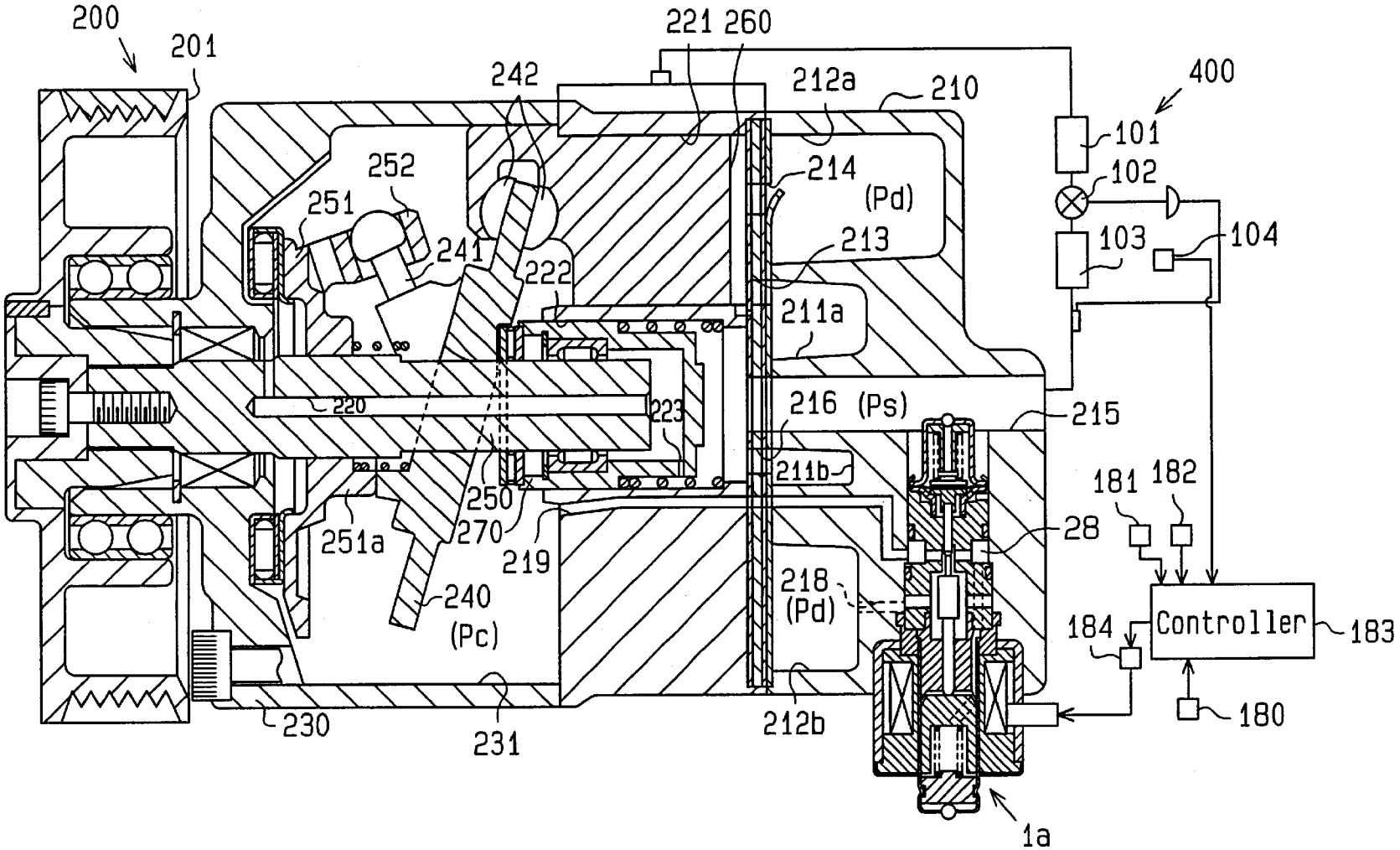
FIG. 7 is a cross-sectional view showing a variable displacement compressor that has the control valve of FIG. 1.
Figure 8:
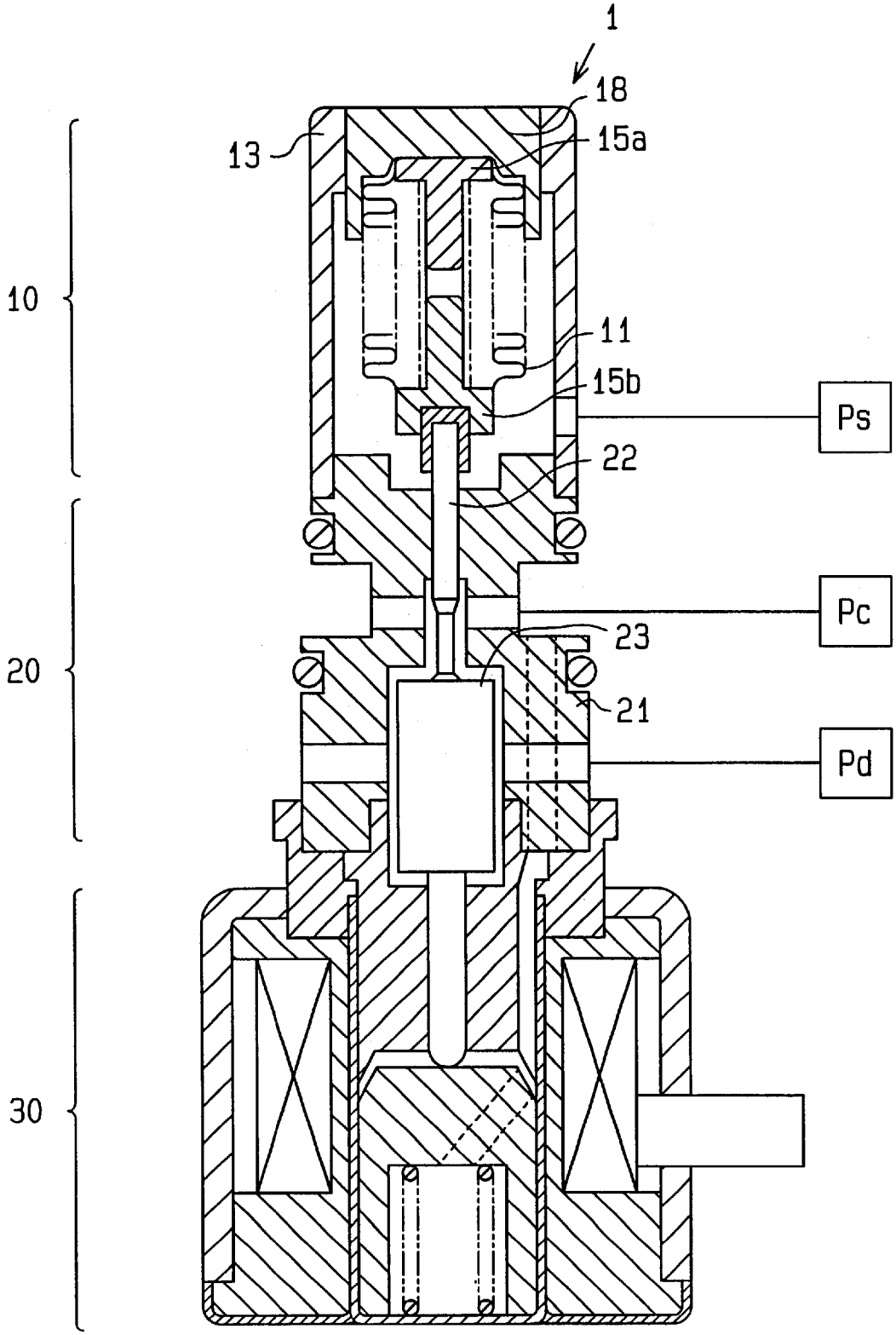
Fig.8(Prior Art)
FIG. 8 is a cross-sectional view showing a conventional control valve.

With reference to FIG. 7, the control valve 1*a* is attached to a rear housing member 210 of a variable displacement compressor 200. The compressor 200 is incorporated in a refrigerant circuit 400. The compressor 200 compresses refrigerant gas and supplies the compressed refrigerant gas from discharge chambers 212*a*, 212*b* to the refrigerant circuit 400. After the compressed refrigerant gas is expanded in the refrigerant circuit 400, the refrigerant gas is recirculated to a suction passage 215, which is formed in the rear housing member 210. Thus, the refrigerant gas at a relatively low pressure flows in the suction passage 215.

A crank chamber 231 of the compressor 200 accommodates a drive shaft 250 rotated by a pulley 201, a rotational support 251 fixed to the drive shaft 250, and a cam plate, or a swash plate 240, which is supported to slide and incline in an axial direction of the drive shaft 250. A support arm 252 of the rotational support 251 supports a guide pin 241 of the swash plate 240. The swash plate 240 is connected to a piston 260 by a pair of shoes 242. The piston 260 is reciprocated in a cylinder bore 221 when the swash plate 240 is rotated.

The stroke of the piston 260 changes depending on the inclination angle of the swash plate 240. The inclination angle of the swash plate 240 changes in relation to the pressure in the crank chamber 231 (crank chamber pressure Pc). A shutter body 270 is urged toward the swash plate 240 and moves in an accommodating recess 222 in accordance with the inclination angle of the swash plate 240.

Suction chambers 211*a*, 211*b* and the discharge chambers 212*a*, 212*b* are formed in the rear housing member 210. When the piston 260 moves, refrigerant gas flows from the suction chambers 211*a*, 211*b* to the cylinder bore 221 through a suction port 213. The refrigerant gas compressed by the piston 260 is discharged to the discharge chambers 212*a*, 212*b* through a discharge port 214. That is, the discharge chambers 212*a*, 212*b* form a discharge pressure zone in which the refrigerant gas at a relatively high pressure (discharge pressure Pd) flows.

The suction passage 215 is connected to the accommodating recess 222 and is also connected to the suction chamber 211*b* by a through hole 216. When the swash plate 240 moves the shutter body 270 toward the rear housing member 210, the shutter body 270 closes the through hole 216. The discharge chamber 212*b* and the crank chamber 231 are connected to each other by supply passages 218, 219. The control valve 1*a* changes the opening sizes of the supply passages 218, 219.

Figure 1:
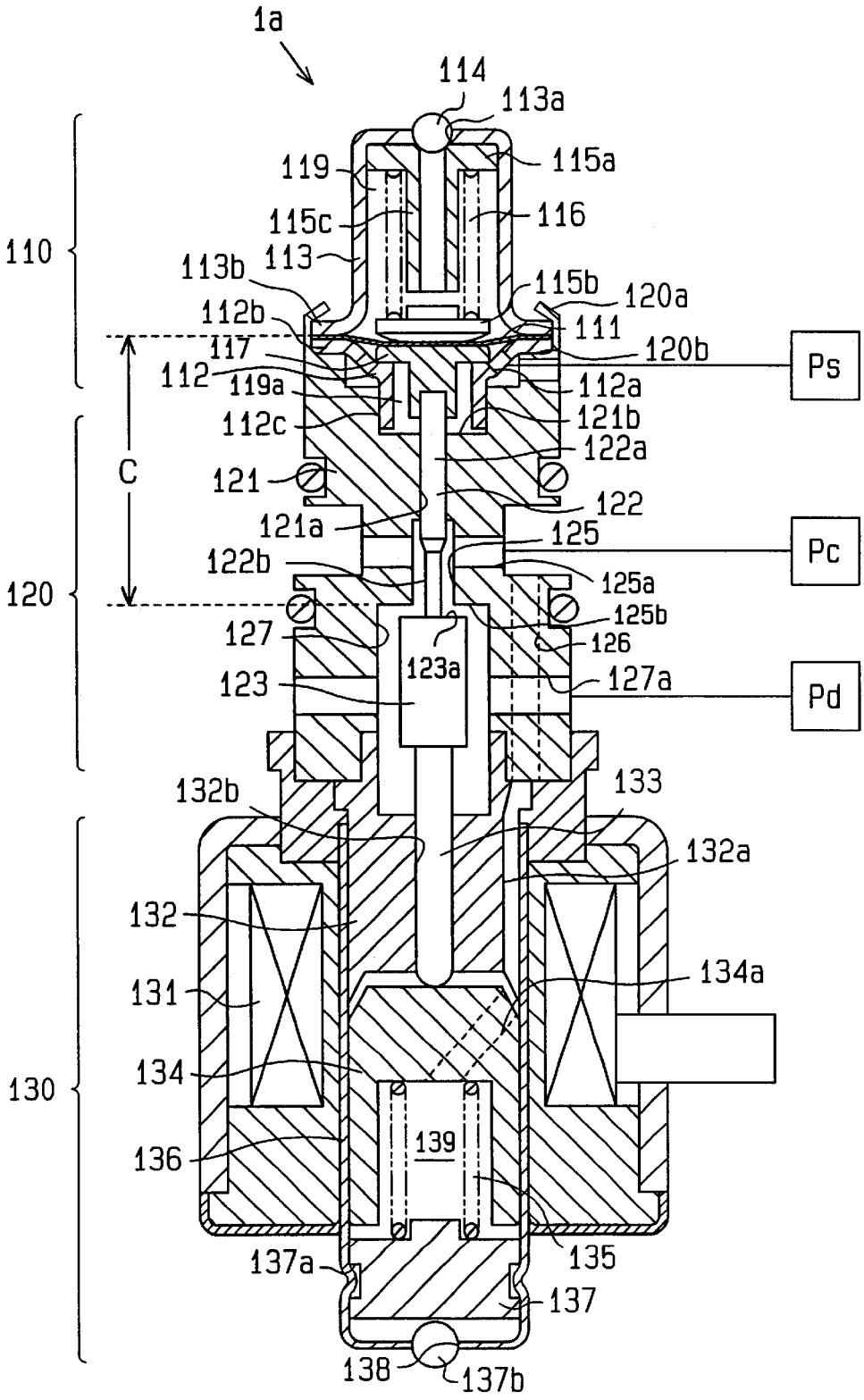
FIG. 1 is a cross-sectional view showing a control valve according to a first embodiment of the present invention.

The control valve 1*a* will hereafter be described with reference to FIG. 1.

The control valve 1*a* includes a pressure sensitive portion 110, a control valve portion 120, and a solenoid portion 130.

The pressure sensitive portion 110 has an upper case (a first case) 113 with an upper flange 113*b* and a lower case (a second case) 112 with a lower flange 112*b*. A pressure sensitive element, or a diaphragm 111, is held between the lower flange 112*b* and the upper flange 113*b*. The diaphragm 111 and the upper case 113 define a pressure sensitive chamber 119. The pressure sensitive chamber 119 is maintained at a predetermined reference pressure (preferably, in substantial vacuum). A dolly block 115*b* is located on the diaphragm 111. A spring holder 115*a* includes a hollow cylindrical portion 115*c*, which extends along the axis of the spring holder 115*a*. A pressure sensitive spring 116, which is held by the dolly block 115*b* and the spring holder 115*a*, urges the dolly block 115*b* toward the diaphragm 111. The upper case 113 includes a top hole 113*a*, or a pressure setting hole. A seal body 114 seals the top hole 113*a*. It is preferred that the top hole 113*a* be circular and that the seal body 114 be spherical.

A connecting member, or a pressure sensitive shaft 117, is received in the lower case 112 to contact the lower side of the diaphragm 111. The lower case 112 includes a connecting projection 112*c*, which is received in a connecting recess 121*b* of a body 121. A suction pressure introducing hole 112*a* is formed in the lower case 112. When the control valve 1*a* is installed in the compressor 200, the pressure sensitive portion 110 is exposed to the suction passage 215 of the compressor 200. Thus, the suction pressure Ps acts on a chamber 119*a* located below the diaphragm 111 through the suction pressure introducing hole 112*a*. When the suction pressure Ps is relatively high, the diaphragm 111 moves upward against the urging force of the pressure sensitive spring 116. In contrast, when the suction pressure Ps is relatively low, the diaphragm 111 moves downward by the urging force of the pressure sensitive spring 116 and the pressure difference. In other words, the diaphragm 111 is deformed depending on the suction pressure Ps.

A process for fabricating the pressure sensitive portion 110 will now be described. First, the spring holder 115*a*, the pressure sensitive spring 116, and the dolly block 115*b* are assembled together and are accommodated in the upper case 113. The pressure sensitive shaft 117 is then received in the lower case 112. The diaphragm 111 is held between the upper flange 113*b* and the lower flange 112*b*. In this state, the upper case 113 and the lower case 112 are joined together. It is preferred that the cases 112, 113 be connected to each other by sealing the outer peripheries of the cases 112, 113 through, for example, plasma welding, lazar welding, or beam welding.

Next, the pressure sensitive portion 110 is placed in an atmosphere at a predetermined reference pressure. For example, the pressure sensitive portion 110 is placed in a pressure changer at the reference pressure. The pressure in the pressure sensitive chamber 119 is thus smoothly equilibrated with the pressure in the pressure chamber by the top hole 113*a* and the hollow body 115*b*. This sets the pressure in the pressure sensitive chamber 119 to the reference pressure. In this state, the seal body 114 closes the top hole 113*a*. The pressure sensitive chamber 119 is sealed by welding the seal body 114 to the upper case 113. After the assembly, the pressure sensitive portion 110 is subjected to a pressure leak test. Next, the pressure sensitive portion 110 is placed in an atmosphere at a predetermined reference pressure. For example, the pressure sensitive portion 110 is placed in a pressure changer at the reference pressure. The pressure in the pressure sensitive chamber 119 is thus smoothly equilibrated with the pressure in the pressure chamber by the top hole 113*a* and the hollow body 115*c*. This sets the pressure in the pressure sensitive chamber 119 to the reference pressure. In this state, the seal body 114 closes the top hole 113*a*. The pressure sensitive chamber 119 is sealed by welding the seal body 114 to the upper case 113. After the assembly, the pressure sensitive portion 110 is subjected to a pressure leak test.

That is, in the first embodiment, the pressure leak test of the pressure sensitive portion 110 is performed before the control valve 1*a* is fabricated. Further, although it is preferred that the pressure sensitive chamber 119 be depressurized to substantially vacuum, gas at the refrigerant pressure may be filled in the pressure sensitive chamber 119. Also, the pressure sensitive portion 110 may be assembled in a depressurized atmosphere.

The control valve portion 120 will now be described.

A valve hole 125 and a valve chamber 127 are formed in the body 121 of the control valve portion 120. The valve chamber 127 accommodates a valve body 123. The valve body 123 includes an end surface 123*a* opposed to a top 125*b* of the valve chamber 127. The body 121 includes a discharge pressure introducing port 127*a*, which is perpendicular to the axis of the body 121 and is connected to the valve chamber 127. With reference to FIG. 7, the discharge pressure introducing port 127*a* is connected to the discharge chamber 212*b* of the compressor 200 by the supply passage 218. The discharge pressure Pd is thus introduced to the valve chamber 127 by the discharge pressure introducing port 127*a*. The body 121 includes a crank pressure introducing port 125*a*, which is connected to the valve hole 125. The crank pressure introducing port 125*a* is connected to the crank chamber 231 of the compressor 200 by the supply passage 219.

The valve body 123 is connected to the pressure sensitive shaft 117 by a pressure sensitive rod 122. The pressure sensitive rod 122 slides in a guide hole 121*a*. The pressure sensitive rod 122 has an upper rod section 122*a*, the diameter of which is substantially equal to the inner diameter of the guide hole 121*a*, and a lower rod section 122*b* of a relatively small diameter, which is formed between the upper rod section 122*a* and the valve body 123. The lower rod section 122*b* allows refrigerant gas to flow in the valve hole 125.

The body 121 includes the connecting recess 121*b*, which receives the connecting projection 112*c* of the pressure sensitive portion 110, a positioning surface 120*b*, which supports the flange of the lower case 112, and an engaging piece 120*a*, which fixes the pressure sensitive portion 110. The positioning surface 120*b* is formed such that the interval C between the diaphragm 111 and the top 125*b* of the valve chamber 127 becomes a predetermined value. The engaging piece 120*a* strengthens the joining between the pressure sensitive portion 110 and the control valve portion 120. The engaging piece 120*a* is engaged with the flange of the upper case 113 in a state in which the flange of the upper case 112 contacts the positioning surface 120*b*. In this state, it is preferred that the lower end of the connecting projection 112*c* be spaced from the bottom of the connecting recess 121*b* of the control valve portion 120.

The following is the explanation about the positioning surface 120*b*. The deformation level of the diaphragm 111 is related to the valve opening pressure of the control valve 1*a*. Further, the reactive force of the diaphragm 111 changes in a curved manner, instead of a linear manner, with respect to the deformation level of the diaphragm 111. It is thus necessary that the initial deformation level of the diaphragm 111 be precisely regulated. In the first embodiment, the interval between the top 125*b* and the positioning surface 120*b* is selected such that the diaphragm 111 is located at a predetermined position when the pressure sensitive portion 110 is attached to the control valve portion 120.

The solenoid portion 130 will hereafter be explained.

The solenoid portion 130, which is joined with the body 121, includes a plunger sleeve 136 with a lower opening, a movable iron core, or a plunger 134, an adjuster 137 fixed to the plunger sleeve 136, and a fixed iron core, or an attractive element 132, which is fitted to an upper opening of the plunger sleeve 136. The plunger sleeve 136, the adjuster 137, and the attractive element 132 define a solenoid chamber 139. A cylindrical coil 131 is located around the attractive element 132 and the plunger 134. The coil 131 is connected to a driver 184, which supplies the coil 131 with an exciting current in response to an instruction of a controller 183.

A solenoid rod guide 132*b*, which connects the solenoid chamber 139 to the valve chamber 127, is formed in the attractive element 132. A solenoid rod 133 is formed integrally with the valve body 123 and is moved axially in the solenoid rod guide 132*b*. The urging force of a solenoid spring 135 enables the lower end of the solenoid guide rod 133 to abut against the plunger 134. Accordingly, the plunger 134, the solenoid rod 133, and the valve body 123 move integrally.

A communication groove 132*a* is formed in a side of the attractive element 132. When the control valve 1*a* is installed in the compressor 200, a gap 28, which is connected to the crank pressure introducing port 125*a*, is formed between the body 121 and the compressor 200 (see FIG. 7). The solenoid chamber 139 is connected to the crank pressure introducing port 125*a* by the communication groove 132*a* of the attractive element 132, a communication hole 126 formed in the body 121, and the gap 28. The pressure in the solenoid chamber 139 is equal to the pressure in the valve hole 125. The plunger 134 includes a plunger hole 134*a*, which is connected to a cavity. This permits refrigerant gas to flow between the space above the plunger 134 and the space below the plunger 134.

The plunger 134 moves in the plunger sleeve 136. The cavity is formed in the bottom of the plunger 134. The solenoid spring 135, which urges the plunger 134 upward, is located between the cavity of the plunger 134 and the adjuster 137. The adjuster 137 adjusts the urging force of the solenoid spring 135 (the compression level of the solenoid spring 135).

The following is to explain adjustment of the solenoid spring 135.

First, the control valve 1*a* is placed in an atmosphere at a predetermined reference pressure. For example, the control valve 1*a* is placed in a depressurized pressure chamber. A tool (not shown) for moving the adjuster 137 is inserted through an adjusting hole 138 of the plunger sleeve 136. As test suction pressure Ps and test discharge pressure Pd are applied respectively to the suction pressure introducing hole 112*a* and the discharge pressure introducing port 127*a*, the pressure in the crank pressure introducing port 125*a* is measured. The position of the adjuster 137 is adjusted by the tool such that the measurement becomes a predetermined value. The plunger sleeve 136 is then caulked to fix the adjuster 137 at the adjusted position. After the tool is removed from the adjusting hole 138, the adjusting hole 138 is closed by welding a seal body 137*b* to the plunger sleeve 136. Adjusting the urging force of the solenoid spring 135, as described, sets the characteristics of the control valve 1*a*.

Next, the operation of the control valve 1*a* will be explained.

When an air conditioner switch 180 is turned on and the passenger compartment temperature, which is detected by a temperature sensor 181, exceeds a target temperature set by a temperature selector 182, the controller 183 instructs to excite the coil 131. The driver 184 supplied the coil 131 with an exciting current in response to the excitement instruction. As excited, the coil 131 enables magnetic circuit members, which are the attractive element 132 and the plunger 134, to form a magnetic circuit. Attractive force is generated between the attractive element 132 and the plunger 134 in accordance with the level of the exciting current. The plunger 134 is thus attracted to the attractive element 132 and urges the valve body 123 upward with the solenoid rod 133. The diaphragm 111 is moved depending on changes in the suction pressure Ps, which is introduced by the suction pressure introducing hole 112*a*. The pressure sensitive rod 122 transmits the movement of the diaphragm 111 to the valve body 123. Accordingly, the opening size of the control valve 1*a* (the opening size of the valve hole 125) is determined by the equilibrium between the urging force of the solenoid portion 130 and the urging force of the pressure sensitive portion 110.

When cooling load is great, the difference between the temperature detected by the temperature sensor 181 and the target temperature selected by the temperature selector 182 is great. As the detected temperature becomes higher, the controller 183 gradually raises the level of the exciting current instructed to the driver 184. In this case, the attractive force between the attractive element 132 and the plunger 134 becomes greater. This increases the force that reduces the opening size of the valve hole 125. Accordingly, the valve body 123 is moved to an open position or a closed position by a relatively low suction pressure Ps. In other words, when the exciting current is relatively high, the control valve 1*a* operates to maintain the suction pressure Ps at a relatively low level.

As the opening size defined by the valve body 123 becomes small, the flow of the refrigerant gas from the discharge chamber 212*b* to the crank chamber 231 through the supply passage 218 is reduced. Meanwhile, the refrigerant gas flows from the crank chamber 231 to the suction chamber 211*b* through a line 220 and a pressure releasing port 223. The crank chamber pressure Pc thus decreases. When the cooling load is great, the difference between the crank chamber pressure Pc and the suction pressure Ps in the cylinder bore 221 is small. Thus, the inclination angle of the swash plate 240 is large.

When the valve body 123 fully closes the valve hole 125, the supply passage 219 is blocked. Thus, the high-pressure refrigerant gas in the discharge chamber 212*b* is not supplied to the crank chamber 231. This substantially equalizes the crank chamber pressure Pc with the pressure Ps in the suction chamber 211*a*. The inclination angle of the swash plate 240 is thus maximized. The maximum inclination angle of the swash plate 240 is restricted by abutment between a restricting projection 251*a* of the rotational support 251 and the swash plate 240. The displacement is thus maximized.

In contrast, when the difference between the temperature detected by the temperature sensor 181 and the target temperature set by the temperature selector 182 is small, the cooling load is small. In this case, as the detected temperature becomes lower, the controller 183 gradually lowers the level of the exciting current instructed to the driver 184. When the exciting current level is relatively low, the attractive force between the attractive element 132 and the plunger 134 is weak. This reduces the force that acts in a direction to reduce the opening size defined by the valve body 123. The valve body 123 is thus moved to the open position or the closed position by a relatively high suction pressure Ps. That is, by decreasing the current level, the control valve 1*a* is operated to maintain the suction pressure Ps at a relatively high level.

When the opening size defined by the valve body 123 becomes large, the flow of the refrigerant gas from the discharge chamber 212*a* to the crank chamber 231 is increased, thus raising the crank chamber pressure Pc. If the cooling load is small, the suction pressure Ps in the cylinder bore 221 is low. The difference between the crank chamber pressure Pc and the suction pressure Ps in the cylinder bore 221 is thus great. Accordingly, the inclination angle of the swash plate 240 is small.

If the temperature detected by the temperature sensor 104 is lower than or equal to the target temperature, the controller 183 instructs the driver 184 to de-excite the coil 131. When the exciting current supplied to the coil 131 is nullified, the attractive force between the attractive element 132 and the plunger 134 is eliminated. The valve body 123 is thus moved to the position at which the valve hole 125 is maximally open. This supplies a large amount of high-pressure refrigerant gas from the discharge chamber 212*b* to the crank chamber 231 through the supply passage 219. The crank chamber pressure Pc is thus raised. In this state, the inclination angle of the swash plate 240 is gradually minimized.

Further, when the air conditioner switch 180 is turned off, the controller 183 instructs the driver 184 to de-excite the coil 131. Also in this case, the inclination angle of the swash plate 240 is gradually minimized.

As described, the control valve 1*a* operates in relation to the exciting current of the coil 131. In other words, the control valve 1*a* changes the target value of the suction pressure Ps depending on the exciting current. When the exciting current level is high, the valve hole 125 is opened at a relatively low suction pressure Ps. When the exciting current level is low, the valve hole 125 is opened at a relatively high suction pressure Ps. The compressor 200 varies its displacement to maintain the suction pressure Ps at the target value.

The control valve 1*a* of the first embodiment has the following advantages.

The control valve 1*a* has the diaphragm 111, which is manufactured inexpensively compared to the conventional bellows 11. This reduces the manufacturing cost of the control valve 1*a*.

The abutment between the positioning surface 120*b* and the lower flange 112*b* sets the interval C between the diaphragm 111 and the valve hole 125 (the top 125*b*) to the predetermined value. The initial deformation level (the spring load) of the diaphragm 111 thus matches a desired value. This makes it easy to set the characteristics of the control valve 1*a*, and the accuracy of the control valve 1*a* is improved.

The positioning surface 120*b* and the top 125*b* are formed in the body 121. Thus, the interval C between the diaphragm 111 and the top 125*b* is set to the predetermined value by attaching the pressure sensitive portion 110 to the control valve portion 120. The accuracy of the control valve 1*a* is thus improved.

The top hole 113*a* is circular and the seal body 114 is spherical. The seal body 114 thus reliably closes the top hole 113*a*. Since the seal body 114 is welded to the upper case 113 in the state closing the top hole 113*a*, entering of flux in the pressure sensitive chamber 119 is avoided. Further, since the seal body 114 and the top hole 113*a* are easy to machine, the manufacturing cost of the control valve 1*a* is reduced.

Since the lower case 112 has the suction pressure introducing hole 112*a*, the suction pressure Ps reliably acts on the pressure sensitive chamber 119 (the diaphragm 111). Further, since the suction pressure introducing hole 112*a* is easy to machine, the manufacturing cost of the control valve 1*a* is decreased.

Even if the suction pressure Ps is excessively high, the lower end of the spring holder 115*a* contacts the dolly block 115*b*. This stops the diaphragm 111 from being excessively moved. The diaphragm 111 is thus prevented from being damaged.

Since the hollow cylindrical portion 115*c* is located in the space surrounded by the pressure sensitive spring 116, the hollow cylindrical portion 115*c* suppresses inclination of the pressure sensitive spring 116. Contact between the dolly block 115*b* and the upper case 113 is thus avoided. The diaphragm 111 is thus not affected by friction resistance, which is otherwise caused between the dolly block 115*b* and the upper case 113, and is deformed accurately depending on a change in the suction pressure. This improves the accuracy of the control valve 1*a*.

The control valves of second to fifth embodiments of the present invention will hereafter be described. The description focuses on the differences of these embodiments with respect to the control valve 1*a* of FIG. 1.

(Second Embodiment)

Figure 2:
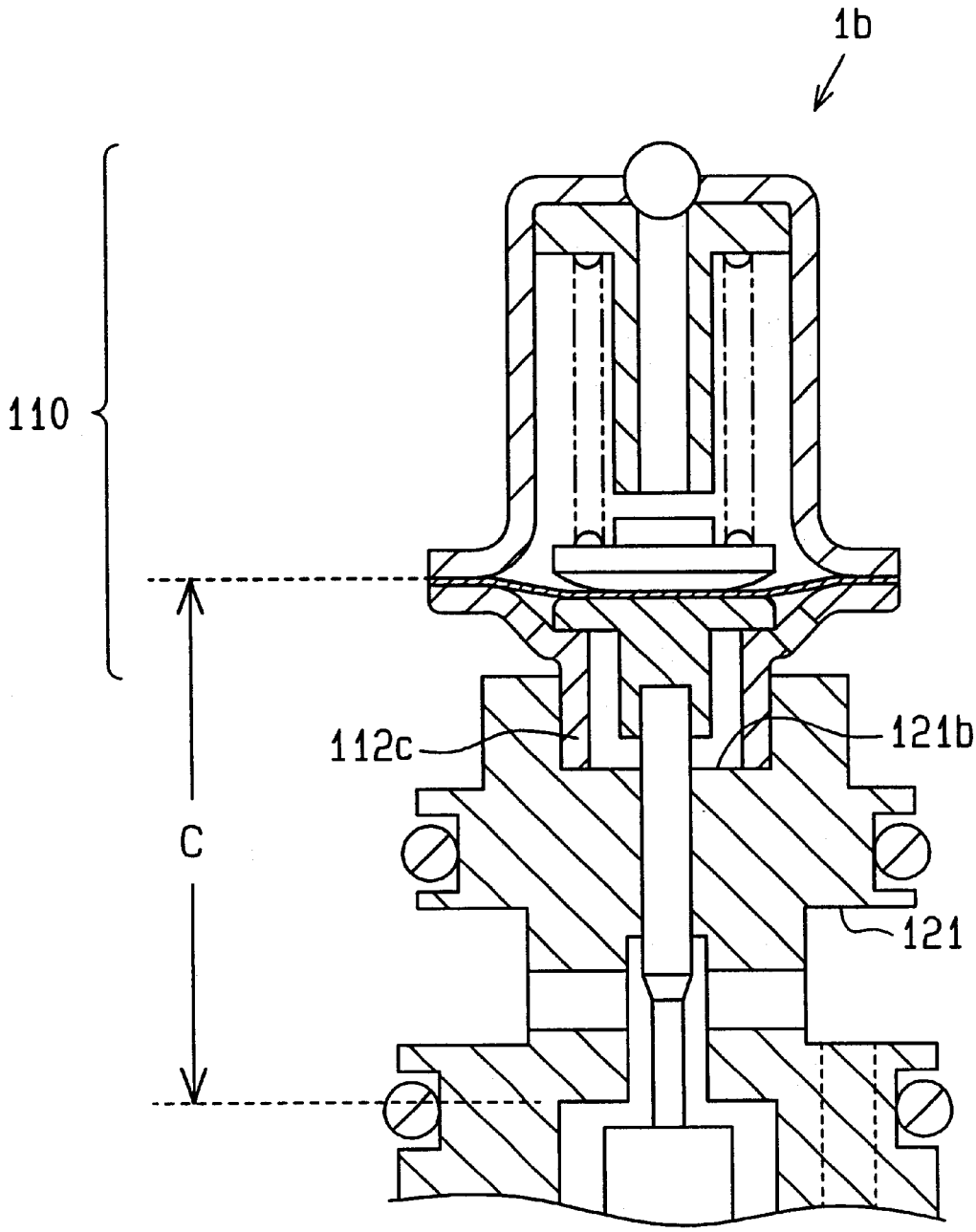
FIG. 2 is a cross-sectional view showing a portion of a control valve according to a second embodiment of the present invention.

FIG. 2 is a cross-sectional view showing a portion of a control valve 1*b* of the second embodiment of the present invention. The control valve portion 120 does not include the engaging piece 120*a* and the positioning surface 120*b* of FIG. 1. Instead, the bottom of the connecting recess 121*b* functions as a positioning surface. More specifically, the depth of the connecting recess 121*b* and the longitudinal dimension of the connecting projection 112*c* are selected such that the interval C between the diaphragm 111 and the valve hole 125 (the top 125*b*) becomes the predetermined value, or the initial deformation level of the diaphragm 111 becomes a desired value, when the lower end of the connecting projection 112*c* of the pressure sensitive portion 110 contacts the bottom of the connecting recess 121*b*. The connecting projection 112*c* is fixed to the connecting recess 121*b* by, for example, pressing the connecting projection 112*c* in the connecting recess 121*b* or securing the connecting projection 112*c* to the connecting recess 121*b* by a screw.

(Third Embodiment)

Figure 3:
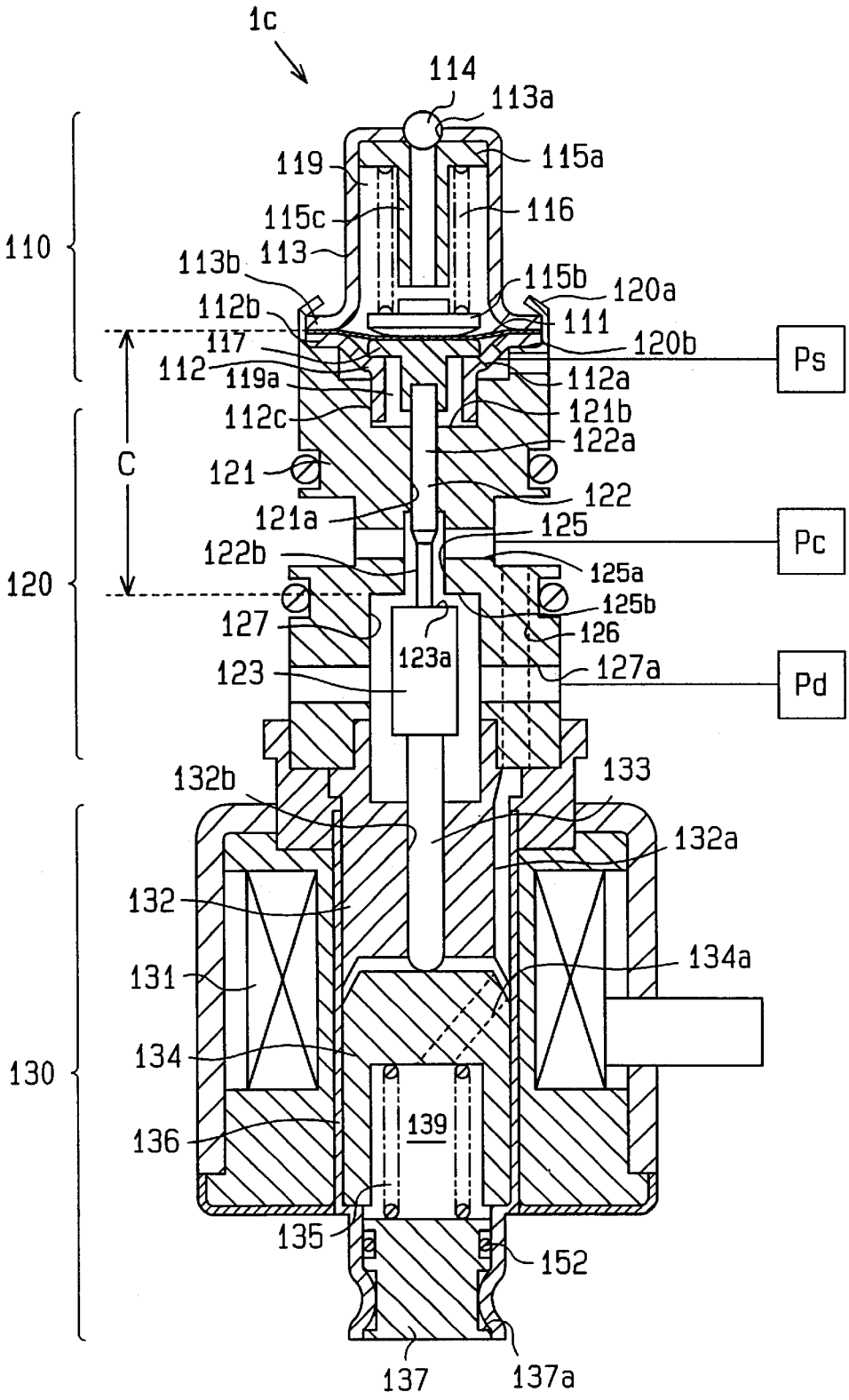
FIG. 3 is a cross-sectional view showing a control valve according to a third embodiment of the present invention.

FIG. 3 is a cross-sectional view showing a control valve 1*c* of the third embodiment of the present invention. The control valve 1*c* has the adjuster 137, which is formed in the solenoid portion 130. The adjuster 137 includes an engaging groove 137*a*, which is formed in a side of the adjuster 137, and an O-ring 152. The position of the adjuster 137 is adjusted such that the control valve 1*c* has desired characteristics. The plunger sleeve 136 is caulked such that a portion of the plunger sleeve 136 is engaged with the engaging groove 137*a*. This fixes the adjuster 137 to the plunger sleeve 136. The O-ring 152, which is attached to the adjuster 137, seals the space between the plunger sleeve 136 and the adjuster 137.

(Fourth Embodiment)

Figure 4:
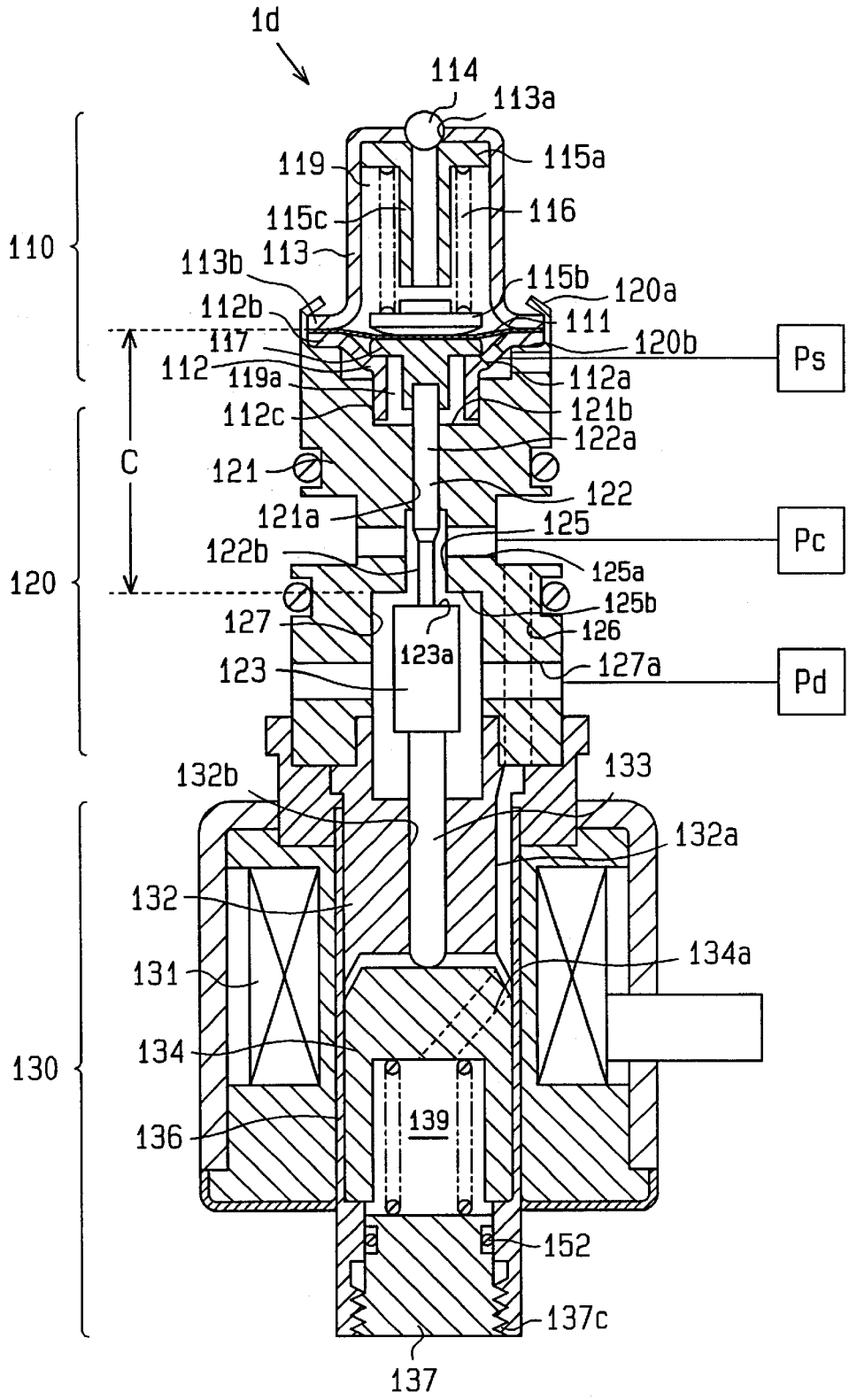
FIG. 4 is a cross-sectional view showing a control valve according to a fourth embodiment of the present invention.

FIG. 4 is a cross-sectional view showing a control valve 1*d* of the fourth embodiment of the present invention. The control valve 1*d* has the adjuster 137, which is formed in the solenoid portion 130. The adjuster 137 has a threaded portion 137*c*, which is formed in a side of the adjuster 137, and the O-ring 152. The adjuster 137 is fixed to the lower opening of the plunger sleeve 136 by a screw. The position of the adjuster 137 is adjusted to obtain the control valve 1*d* with desired characteristics. The O-ring 152 seals the space between the plunger sleeve 136 and the adjuster 137.

(Fifth Embodiment)

Figure 5:
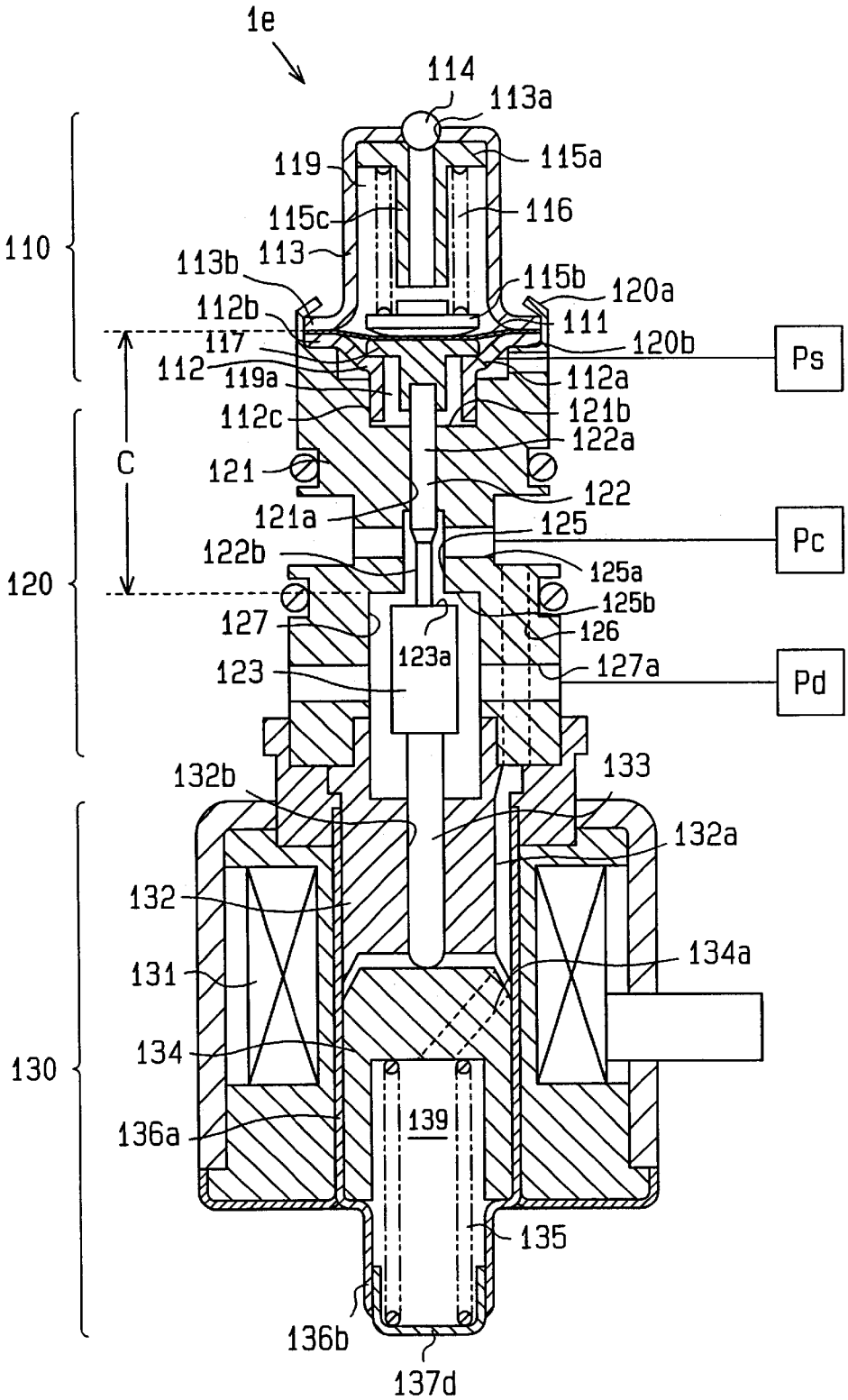
FIG. 5 is a cross-sectional view showing a control valve according to a fifth embodiment of the present invention.

FIG. 5 is a cross-sectional view showing a control valve 1*e* of the fifth embodiment of the present invention. The control valve 1*e* has the adjuster 137*d*, which is formed in the solenoid portion 130. The plunger sleeve 136 includes a large diameter portion 136*a*, which is located around the plunger 134, and a small diameter portion 136*b*, which is located below the large diameter portion 136*a*. The position of the adjuster 137*d* is adjusted to obtain the control valve 1*d* with desired characteristics. The adjuster 137*d* is welded to the small diameter portion 136*b* at the adjusted position. The space between the plunger sleeve 136 and the adjuster 137*d* is sealed through welding.

(Sixth Embodiment)

Figure 6:
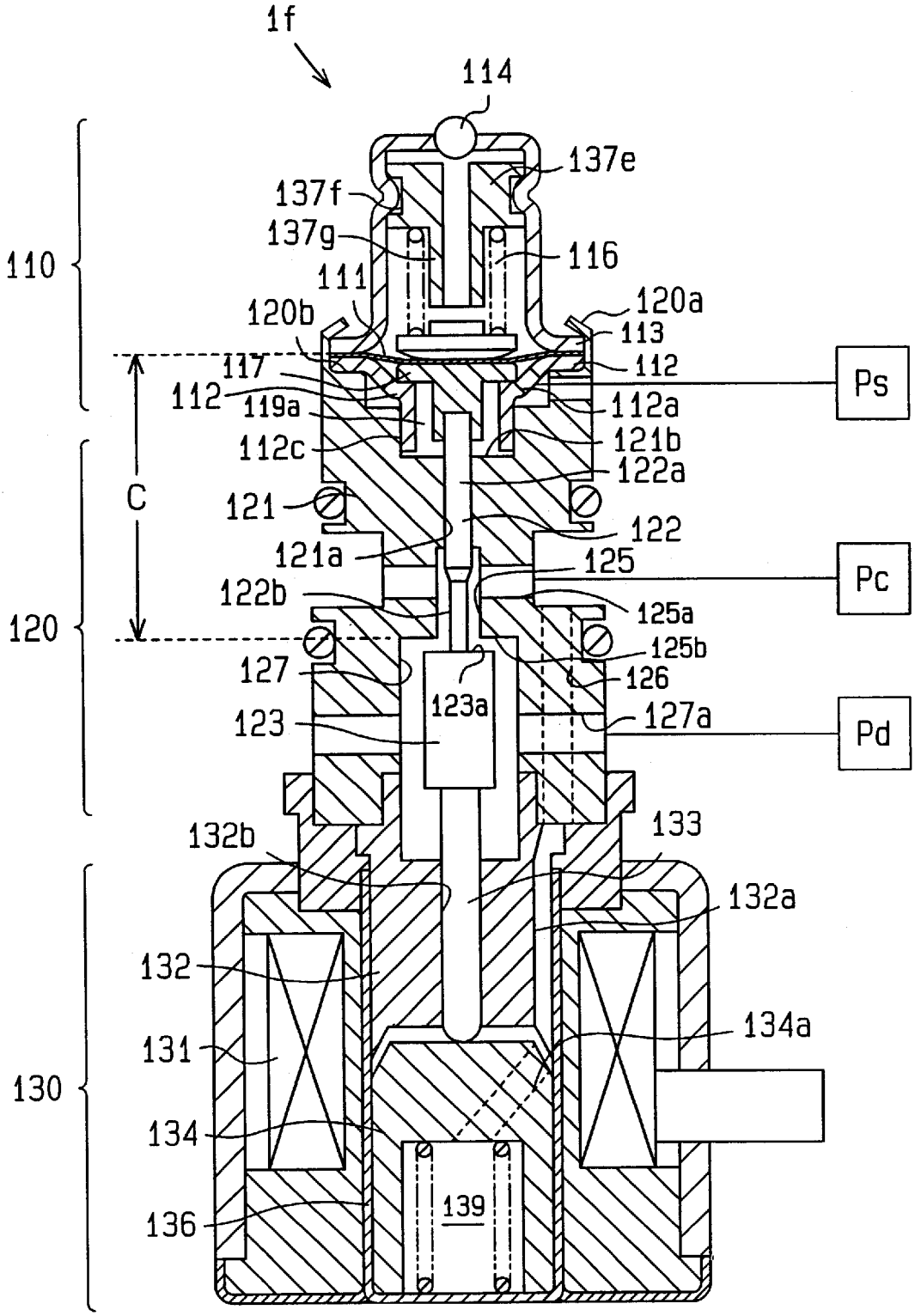
FIG. 6 is a cross-sectional view showing a control valve according to a sixth embodiment of the present invention.

FIG. 6 is a cross-sectional view showing a control valve 1*f* of the sixth embodiment of the present invention. In the sixth embodiment, the plunger sleeve 136 has a closed bottom. An adjuster 137*e* is formed in the pressure sensitive portion 110. More specifically, the adjuster 137*e* is accommodated in the upper case 113. The adjuster 137*e* includes an engaging groove 137*f*, which is formed in a side of the adjuster 137*e*, and a hollow cylindrical portion 137*g*, which extends along the axis of the adjuster 137*e*. Like the spring holder 115*a* of FIG. 1, the adjuster 137*e* holds the upper end of the pressure sensitive spring 116. The characteristics of the control valve 1*f* are regulated as follows.

A tool is inserted through the top hole 113*a* to adjust the position of the adjuster 137*e* such that the control valve 1*e* has desired characteristics. A portion of the upper case 113 is engaged with the engaging groove 137*f* by caulking the upper case 113. This fixes the adjuster 137*e* at the adjusted position. The longitudinal dimension, or the urging force, of the pressure sensitive spring 116 is thus adjusted to regulate the characteristics of the control valve 1*f*. Afterward, the seal body 114 is welded to the upper case 113 by the procedure described about the first embodiment. This seals the pressure sensitive chamber 119. In the sixth embodiment, the top hole 113*a* functions as a pressure setting hole and an adjusting hole.

The control valves 1*b* to 1*f* of the second to sixth embodiments have the same advantages as those of the first embodiment.

The embodiments of the present invention have been described in conjunction with the drawings. However, the present invention is not restricted to the above description but may be modified within the scope of the attached claims or with their equivalent forms.

What is claimed is:

1. A control valve of a variable displacement compressor including a suction passage in which refrigerant gas at a relatively low pressure flows, a discharge pressure zone in which the refrigerant gas compressed at a relatively high pressure flows, a crank chamber that accommodates a cam, and a supply passage that connects the discharge pressure zone to the crank chamber, wherein the control valve comprises:

a body, which accommodates a valve body that opens or closes a valve hole connected to the supply passage; and a pressure sensitive portion, which is fixed to the body for detecting the pressure in the suction passage, and the pressure sensitive portion includes:

a diaphragm, which is deformed in relation to the pressure in the suction passage;

a first case, which has a first flange and cooperates with the diaphragm to define a pressure sensitive chamber; and a second case, which has a second flange that cooperates with the first flange to hold the diaphragm, wherein the outer periphery of the first flange is welded to the outer periphery of the second flange, wherein the body has a positioning surface for positioning the diaphragm by contacting the second case, and wherein the positioning surface is formed such that the interval between the diaphragm and the valve hole becomes a predetermined value.

2. The control valve according to claim 1, characterized in that the first case has a pressure setting hole for setting the pressure sensitive chamber to a predetermined reference pressure, and that the control valve further includes a seal body for sealing the pressure setting hole.

3. The control valve according to claim 1, characterized in that the body has an engaging piece for fixing the pressure sensitive portion.

4. The control valve according to claim 3, characterized in that the positioning surface contacts the second flange, and that the engaging piece is engaged with the first flange.

5. The control valve according to claim 1, characterized in that the diaphragm includes a first side, which faces the pressure sensitive chamber, and a second side opposed to the first side, that the pressure sensitive portion further includes a pressure sensitive spring, which urges the diaphragm toward the valve body, and a pair of dolly blocks, which holds opposite ends of the pressure sensitive spring, and that the pressure sensitive spring and the dolly blocks are located in the pressure sensitive chamber.

6. The control valve according to claim 5, characterized in that the second case has a suction pressure introducing hole for enabling the pressure in the suction passage to act on the second side of the diaphragm.

7. A control valve of a variable displacement compressor including a suction passage in which refrigerant gas at a relatively low pressure flows, a discharge pressure zone in which the refrigerant gas compressed at a relatively high pressure flows, a crank chamber that accommodates a cam, and a supply passage that connects the discharge pressure zone to the crank chamber, wherein the control valve comprises:

a pressure sensitive portion, which detects the pressure in the suction passage, and the pressure sensitive portion includes:

a diaphragm, which is deformed in relation to the pressure in the suction passage;

a first case, which has a first flange and cooperates with the diaphragm to define a pressure sensitive chamber; and a second case, which has a second flange that cooperates with the first flange to hold the diaphragm;

a body, which is fixed to the pressure sensitive portion and accommodates a valve body for opening or closing a valve hole connected to the supply passage, wherein said body includes a positioning surface, which is formed in the body for positioning the diaphragm by contacting the second case, wherein the positioning surface is formed such that the interval between the diaphragm and the valve hole becomes a predetermined value.

8. The control valve according to claim 7, characterized by an engaging piece, which is formed in the body for fixing the pressure sensitive portion.

9. The control valve according to claim 8, characterized in that the positioning surface contacts the second flange, and that the engaging piece is engaged with the first flange.

10. The control valve according to claim 7, characterized in that the control valve further includes a solenoid portion, which is fixed to the body, and the solenoid portion includes:

a coil;

a movable iron core, which moves the valve body when the coil is excited;

a spring, which urges the movable iron core toward the pressure sensitive portion;

a plunger sleeve, which accommodates the movable iron core end the spring; and an adjuster, which is attached to the plunger sleeve for changing the characteristics of the control valve by adjusting the urging force of the spring.

11. The control valve according to claim 10, characterized in that the adjuster is fixed to the plunger sleeve by caulking the plunger sleeve.

12. The control valve according to claim 11, characterized in that the plunger sleeve has an adjusting hole, that the position of the adjuster is adjusted by means of the adjusting hole, that the solenoid portion further includes a seal body for closing the adjusting hole, and that the seal body is welded to the plunger sleeve after the adjuster is fixed to the plunger sleeve.

13. The control valve according to claim 11, characterized in that the first case has a pressure setting hole, that the position of the adjuster is adjusted by means of the pressure setting hole, that the pressure sensitive portion further includes a seal body for closing the pressure setting hole, and that the seal body is welded to the first case after the adjuster is fixed to the first case.

14. The control valve according to claim 10, characterized in that the adjuster is fixed to the plunger sleeve through welding.

15. The control valve according to claim 10, characterized in that the adjuster is an adjuster with a spring, which is capable of changing the position of the adjuster relative to the plunger sleeve.

16. The control valve according to claim 7, characterized in that the pressure sensitive portion further includes a pressure sensitive spring, which urges the diaphragm toward the valve body, a dolly block, which contacts the diaphragm and holds one end of the pressure sensitive spring, and an adjuster, which holds the other end of the pressure sensitive spring for adjusting the urging force of the pressure sensitive spring, and that the pressure sensitive spring, the dolly block, and the adjuster are located in the pressure sensitive chamber.

17. A method for manufacturing a control valve of a variable displacement compressor, wherein the control valve includes a body, which accommodates a valve body that changes the opening size of a valve hole, and a pressure sensitive portion, which is attached to the body for detecting the pressure in the compressor, and the method is characterized by the steps of:

forming a positioning surface in the body at a position corresponding to a predetermined interval from the valve hole;

accommodating a pressure sensitive spring and a pair of dolly blocks, which holds opposite ends of the pressure sensitive spring, in a first case that has a first flange and a pressure setting hole;

accommodating a connecting member in a second vase that has a second flange;

fixing the first case and the second case by clamping a diaphragm between the first flange and the second flange;

setting the pressure in a pressure sensitive chamber, which is defined by the diaphragm and the first case, to a predetermined value, wherein said step of setting the pressure includes the steps of:

depressurizing the pressure sensitive chamber by means of the pressure setting hole;

closing the pressure setting hole by a seal body; and welding the seal body to the first case; and attaching the pressure sensitive portion to the body by enabling the second case to contact the positioning surface of the body.

* * * * *